United States Patent [19]

Hata et al.

[11] 4,368,081

[45] Jan. 11, 1983

[54] METHOD FOR REMOVING RESIDUAL HYDROGEN PEROXIDE ON A STERILIZED FOOD PACKAGE

[75] Inventors: Kunio Hata; Kihachiro Oshima; Isao Kano; Norio Matsukura; Hiroaki Umeda; Motoi Matsui; Tetsushi Ashida; Yoichi Nishiguchi; Nobushige Yasui, all of Tokyo, Japan

[73] Assignee: Jujo Paper Co., Ltd., Tokyo, Japan

[21] Appl. No.: 294,805

[22] Filed: Aug. 20, 1981

[30] Foreign Application Priority Data

Sep. 5, 1980 [JP] Japan ..... 55/122351

[51] Int. Cl.[3] ..... B08B 3/08

[52] U.S. Cl. ..... 134/2; 134/3; 134/28; 134/30; 134/42; 422/30

[58] Field of Search ..... 134/2, 3, 27, 42, 28, 134/30; 422/2, 28, 30; 53/425, 426, 431, 432, 111 RC; 426/320, 399

[56] References Cited

U.S. PATENT DOCUMENTS 3,904,361 9/1975 Egger ..... 53/426 X 3,912,451 10/1975 Gaglia ..... 422/30

FOREIGN PATENT DOCUMENTS 13132 7/1980 European Pat. Off. ..... 53/426

OTHER PUBLICATIONS

Furia, *Handbook of Food Additives,* 2nd Ed., vol. 1, 1972, pp. 796, 829, 946.

Condensed Chemical Dictionary, 1971, pp. 81, 257, 420, 817.

*Primary Examiner*—Marc L. Caroff

*Attorney, Agent, or Firm*—Koda and Androlia

[57] ABSTRACT

Packing material for foodstuff is sterilized with hydrogen peroxide. Residual hydrogen peroxide on the material is then removed by contacting the material with an anti-oxidant or reducing agent which is an approved food additive. L-ascorbic acid is preferred.

4 Claims, No Drawings

METHOD FOR REMOVING RESIDUAL HYDROGEN PEROXIDE ON A STERILIZED FOOD PACKAGE

BACKGROUND OF THE INVENTION

1. Field of the Invention

This invention relates to a method for removing residual hydrogen peroxide on the packing materials of foodstuff which have been sterilized with hydrogen peroxide.

2. Prior Art

Hydrogen peroxide has been widely used for bleaching foodstuff and for sterilizing packing materials, containers, etc. for foodstuff. Since it has been recently pointed out that residual hydrogen peroxide in foodstuff may have an undesirable effect on the human body, the application of hydrogen peroxide to food-industries is being limited strictly. The same holds true for hydrogen peroxide treatment for sterilizing the packing materials for foodstuff, such as food-containers, the equipment for packaging or packing. According to the Standard of Food-Additives (Notice No. 24 by Japan Welfare Ministry issued Mar. 20, 1975), it is required to remove throughly residual hydrogen peroxide on the packing equipment for foodstuff, before foodstuff comes into contact with the equipment. The method for sterilizing materials for foodstuff with hydrogen peroxide differs more or less depending on the form, kind and uses.

There was ordinarily employed a method wherein the packing materials for foodstuff were treated at high temperature with hot air, etc. to enhance sterilizing effect by generating nascent oxygen after contact with hydrogen peroxide on the materials, to remove residual hydrogen peroxide and to keep sterilizing condition till food packaging or packing process. However, this method makes it difficult to remove throughly the residual hydrogen peroxide on the packing materials for foodstuff. It was known to use enzyme or chemicals as a method for removing hydrogen peroxide in food processing. Concretely, the following methods have been proposed: an addition of a catalyst for decomposing hydrogen peroxide; an addition sodiumsulfite or sodium hydrosulfite as reducing agent; an addition of wheat bran and its water extracts in producing pickles (see the Japanese Patent Publication No. 30337/1980); and an addition of magnesium oxide etc. (see the Japanese Patent Publication No. 30338/1980).

For removing residual hydrogen peroxide on the packing materials for foodstuff which have been sterilized with hydrogen peroxide, the application of catalase or chemicals has many disadvantages; since enzyme is expensive and unstable to heat, and since sulfur-containing chemicals such as sodium monosulfite, sodium hydrosulfite, etc., are converted to sulfur dioxide to be hold as harmful substance in foodstuff.

Moreover, enzyme-and sulfur-containing chemicals have such disadvantages that they can not treat packing materials for foodstuff rapidly, because they require too long time for complete decomposition or removal of residual hydrogen peroxide.

SUMMARY OF THE INVENTION

An object of this invention is to provide a method for removing the residual hydrogen peroxide on the packing materials for foodstuff sterilized with hydrogen peroxide.

The above object is accomplished by treating the packing materials for foodstuff with antioxidants or reducing substances food-additives. Such antioxidants or reducing substances is allowed to react with hydrogen peroxide simultaneously and are effective for removing the residual hydrogen peroxide on the packing equipment for foodstuff.

DETAILED DESCRIPTION OF THE INVENTION

The antioxidants of this invention which are available as food additives include L-ascorbic acid; L-ascorbic acid derivatives, such as stearic acid ester of L-ascorbic acid, sodium salt of L-ascorbic acid, sorbic acid; sorbic acid derivatives, such as potassium or sodium salt of sorbic acid; phenolic derivatives, such as gallic acid isoamylester, gallic acid propylester, dibutylhydroxytoluene, butylhydroxyamisole and α-tocopherol, all of which are used as food-additives.

The reducing substances of this invention which are available as food-additives include cysteine and glutathione of reduced type.

In this invention, one or more of the above-identified antioxidants or reducing substances may be employed depending on the purpose.

The fact that the above-identified substances decompose and remove a slight amount of hydrogen peroxide rapidly is proved by the following organic spots-test (by F. Feigel, "Organic Spot-Test", page 494 (1958), published by Kyoritsu Shuppan). The substance in this invention is added to aqueous hydrogen peroxide solution and then the hydrogen peroxide-detecting agent prepared from 2,7-dinitorfluorene, haemin and glacial acetic acid is added thereto. Then, the resultant solution does not show the blue color characteristic of hydrogen peroxide. The solution of antioxidants or reducing substances of this invention are prepared by using an appropriate solvent and are uniformly brought into contact with the packing materials for foodstuff sterilized with hydrogen peroxide by coating, spraying, etc. Furthermore, the packing materials for foodstuff sterilized with hydrogen peroxide are dried at high temperature with hot air, etc. to lessen the residual hydrogen peroxide and then are coated or sprayed with the solution of this invention, whereby the hydrogen peroxide on the packing materials for foodstuff may be removed effectively. Since a slight amount of hydrogen peroxide remains on the packing materials for foodstuff by treating at high temperature with hot air, the solution of an antioxidant or a reducing substance is prepared in concentration of 10–20,000 parts per million, preferably 100–1500 parts per million, and is sterilized by heating or is subjected to germ-removal through a membrane. Then, the resultant solution is sprayed or coated on the surface of the packing materials for foodstuff. Since the amount of an antioxidant or a reducing agent required is 1.2–2.0 times the equivalent amount of residual hydrogen peroxide, the amount of antioxidant or reducing agent required for decomposition of hydrogen peroxide may be readily controlled by determining the amount of the residual hydrogen peroxide beforehand, whereby the use of excess amount of the antioxidant or reducing agent may be avoided.

There are two kinds of substances in this invention, that is, watersoluble and oilsoluble. They may be used appropriately according to the object, but water-soluble substances are preferable due to its easy handling.

Hereinafter, this invention will be described more specifically by the typical examplary formluations of the preferred embodiments thereof and by reference examples.

EXAMPLE 1

Onto the inner surface of a carton of one liter content is sprayed 0.4 ml of 30% aqueous hydrogen peroxide solution. After the inner surface of the carton was sterilized, it was dried by blowing hot air of 90° C. The residual hydrogen peroxide in the carton was 10 μg by the determination according to the iodometry (by Osamu Toda and Kenji Nakaaki "Determination and Evaluation of Environmental Harm-Substances, First Volume, Inorganic part", page 323 (1979), published by the Institute for Science and Labor).

After 0.2 ml of aqueous solution of L-ascorbic acid with a concentration of 1000 parts per million was sprayed on the inner surface of the carton under sterilized state, the amount of the residual hydrogen peroxide was determined according to the above iodometrie. Consequently, it was found that there was no detectable amount of the hydrogen peroxide and that the hydrogen peroxide is removed throughly by the decomposition. In the same procedure, aqueous solutions of various antioxidants or reducing substances (concentration of 1000 parts per million) capable of using as food additives were sprayed into the inner surface of the carton which had been previously sterilized with above-mentioned hydrogen peroxide and which had been dried by hot air.

The residual hydrogen peroxide was not indentified by the iodometrie. The results of removing the residual hydrogen peroxide with such antioxidants or reducing substances are shown in Table 1.

TABLE 1

| | Solvent | Odor | Required amount (ml) |
|---|---|---|---|
| L-ascorbic acid | water | no | 0.2 |
| Stearic acid ester of L-ascorbic acid | ethanol | no | 1.5 |
| Sodium salt of L-ascorbic acid | water | no | 1.0 |
| Sorbic acid | water | no | 1.0 |

TABLE 1-continued

| | Solvent | Odor | Required amount (ml) |
|---|---|---|---|
| Potassium salt of sorbic acid | water | no | 1.0 |
| Sodium salt of sorbic acid | water | no | 1.0 |
| Cysteine | water | slight odor | 0.2 |
| Glutathione of reduced type | water | slight odor | 0.5 |

Remarks:

In Table 1, "required amount" is the amount of aqueous solution of various substances (with a concentration of 1000 part per million) required for removing 10 μg of hydrogen peroxide.

As seen in Table 1, L-ascorbic acid is handled easily due to its great water solubility, has no bad effect on working environment due to odorless feature, permits more rapid treatment due to a smaller amount required for decomposing and removing the residual hydrogen peroxide. Therefore, L-ascorbic acid is the most useful substance among various antioxidants or reducing substances used as food-additives.

We claim:

1. In a method for removing residual hydrogen peroxide on packing material for foodstuff sterilized with hydrogen peroxide, the improvement comprising removing said residual hydrogen peroxide on the surface of the packing material for foodstuff by applying to the surface of said packing material an anti-oxidant or reducing agent selected from the group consisting of L-ascorbic acid, stearic acid ester of L-ascorbic acid, sodium salt of L-ascorbic acid, sorbic acid, potassium salt of sorbic acid, sodium salt of sorbic acid, gallic acid isoamylester, gallic acid propylester, dibutylhydroxytoluene, butylhydroxyanisole, α-tocopherol, cysteine, and glutathione of reduced type.

2. Method according to claim 1, wherein said agent is coated on the packing materials to treat said residual hydrogen peroxide.

3. Method according to claim 1, wherein said agent is sprayed on the packing material to treat said residual hydrogen peroxide.

4. Method according to claim 1, wherein said packing material is dried by hot air before being treated with said agent.

* * * * *